US011799240B2

(12) United States Patent
Dobernig et al.

(10) Patent No.: US 11,799,240 B2
(45) Date of Patent: Oct. 24, 2023

(54) ELECTRICAL CONNECTOR WITH A LEVER LOCKING MEMBER AND MATE ASSIST MECHANISM

(71) Applicant: Aptiv Technologies (2) S.à.r.l., Luxembourg (LU)

(72) Inventors: Norbert Dobernig, Nuremberg (DE); Prasanna Ramakrishnan, Chennai-Tamilnadu (IN)

(73) Assignee: Aptiv Technologies (2) S.à.r.l., Luxembourg (LU)

( * ) Notice: Subject to any disclaimer, the term of this patent is extended or adjusted under 35 U.S.C. 154(b) by 103 days.

(21) Appl. No.: 17/529,528

(22) Filed: Nov. 18, 2021

(65) Prior Publication Data

US 2022/0166165 A1 May 26, 2022

(30) Foreign Application Priority Data

Nov. 20, 2020 (GB) ..... 2018304

(51) Int. Cl.
*H01R 13/641* (2006.01)
*H01R 13/629* (2006.01)
*H01R 13/52* (2006.01)

(52) U.S. Cl.
CPC ... *H01R 13/62955* (2013.01); *H01R 13/5202* (2013.01); *H01R 13/641* (2013.01); *H01R 2201/26* (2013.01)

(58) Field of Classification Search
CPC ..... H01R 13/62955; H01R 13/5202; H01R 13/641; H01R 2201/26
See application file for complete search history.

(56) References Cited

U.S. PATENT DOCUMENTS

| | | | | |
|---|---|---|---|---|
| 7,361,036 | B2 * | 4/2008 | Pittenger | H01R 13/62933 439/157 |
| 9,178,307 | B2 * | 11/2015 | Papurcu | H01R 13/62977 |
| 10,135,183 | B1 * | 11/2018 | Probert | H01R 13/62966 |
| 10,177,493 | B2 * | 1/2019 | Yildiz | H01R 13/62927 |
| 10,218,117 | B1 * | 2/2019 | Probert | H01R 12/712 |
| 10,270,207 | B1 * | 4/2019 | Probert | H01R 13/502 |
| 10,270,208 | B1 * | 4/2019 | Probert | H01R 13/6295 |
| 2019/0123485 | A1 | 4/2019 | Probert et al. | |

FOREIGN PATENT DOCUMENTS

| | | | |
|---|---|---|---|
| EP | 0975065 | A2 | 1/2000 |
| EP | 1077512 | A2 | 2/2001 |
| EP | 2454785 | A1 | 5/2012 |
| EP | 3058625 | A1 | 8/2016 |
| JP | 2013182874 | A | 9/2013 |

* cited by examiner

*Primary Examiner* — Tho D Ta

(74) *Attorney, Agent, or Firm* — Billion & Armitage

(57) ABSTRACT

The present disclosure provides an electrical connector comprising first and second connector housings configured to be coupled and uncoupled from one another via a mate assist mechanism comprising a lever. The lever is configured to be positioned, when the first and second connector housings are in an uncoupled state or the second connector housing is absent, at a pre-lock position, whereby a blocking element of the lever is configured to cooperate with a blocking surface of the first connector housing, the electrical connector comprising a lever seal and a panel seal.

20 Claims, 8 Drawing Sheets

ELECTRICAL CONNECTOR WITH A LEVER LOCKING MEMBER AND MATE ASSIST MECHANISM

CROSS-REFERENCE TO RELATED APPLICATION

This application claims benefit of priority to Great Britain Patent Application No. 2018304.2 filed on Nov. 20, 2020, the entire disclosure of which is hereby incorporated by reference.

TECHNICAL FIELD OF THE INVENTION

The present application relates to an electrical connector assembly including a male connector housing and a female connector housing configured to be uncoupled from and coupled to one another via a mate assist lever locking mechanism, and more particularly, to a sealed electrical connector with a mechanism for releasing the mate assist lever locking mechanism from a pre-lock position.

BACKGROUND

Electrical connectors, such as those used in the automotive industry, usually include a male connector housing and a female connector housing configured to be uncoupled from and coupled to one another via a lever mechanism.

In many fields of applications, in particular, in the case of mass production assembly processes, it is important that electrical connectors can be connected easily and fast. Therefore, it is common that the connectors are provided with mate assist mechanisms in the form of mate assist levers or sliders to facilitate mating of the male and female connector housings.

The mate assist levers may be linearly or pivotably movable on a connector housing. Upon mating of the connector with a corresponding mating connector, the mate assist levers are moved from a first position, pre-lock position, to a second position, locked position, thereby facilitating the mating process.

It is common in the connectors of the prior art to releasably secure the mate assist lever in the pre-lock position to prevent the accidental movement of the lever when one of the connectors is not present. For example, a blocking element may be provided in the path of the mate assist lever to prevent unintentional movement of the lever in the locked position. Once the connector housings are brought together, the mate assist lever may be released from the pre-lock position so that it can be moved to the locked position to secure the connector housings in a mated state.

An example of such a mate assist arrangement is disclosed in EP2454785 and U.S. Pat. No. 9,178,307, whereby the blocking element is provided along the path of the mate assist lever to maintain the lever in the pre-lock position. Upon bringing together the connector housings, the blocking element is pushed out of the way of the mate assist lever path, and the lever becomes free to move to the locked position to secure the male and female connector housings in the mated state.

However, the mate assist arrangements described in the prior art are only applicable to non-sealed electrical connectors. For sealed connectors, such as those used for door to body connections, all parts of the connector, including the lever, are sealingly mounted to prevent water and dust from entering the electrical connector. Furthermore, in the prior art examples, the release of the lever from the pre-lock position requires the operator to hold the connector housings with one hand while operating the lever with the other hand. However, such an arrangement is problematic when the electrical connector is to be assembled in tight spaces. For example, in the assembly of a door to body connector where the female connector needs to be assembled with the header in an upright down position, due to space restrictions, the operator may be able to use only one hand. As such one of the connector housings may fall before the locking process with the mate assist lever is completed.

SUMMARY

It is the aim of the present disclosure to provide a sealed electrical connector with a mate assist mechanism for releasing the mate assist lever from the pre-lock position without compromising the seal of the electrical connector.

It is a further aim of the present disclosure to provide a locking mechanism for maintaining the female and male connectors in a pre-mated state, thereby enabling for the locking operation to be completed using only one hand.

According to an aspect of the present disclosure, an electrical connector assembly is provided. The electrical connector includes a first connector housing and a second connector housing configured to be coupled to one another through an opening of a panel. The second connector housing is configured to fit inside the first connector housing. The electrical connector further includes a mate assist mechanism including a lever. The lever is pivotably and sealingly mounted to an outside of the first connector housing. The mate assist mechanism is configured to couple and uncouple the first and second connector housings by pivoting of the lever between a pre-lock position and a locked position. The lever includes a locking mechanism configured to engage with a corresponding locking mating member of the second connector to secure the first and second connector housings in a mated state upon pivoting the lever to the locked position. The lever also includes a blocking element configured to cooperate with a blocking surface of the first connector housing to maintain the lever in the pre-lock position when the first and second housings are in an uncoupled state or when the second connector housing is absent. The locking mating member of the second connector includes an activation element configured to cooperate with a corresponding activation member on the locking mechanism of the lever when the first and second connector housings are in a pre-mated state. The activation element is configured to exert a biasing force on the corresponding activation member of the locking mechanism, thereby causing the lever to be displaced outwardly from the first connector housing such that the blocking element of the lever is released from the blocking surface of the first connector housing and the lever becomes free to move to the locked position. The first connector housing includes a lever seal for sealing an opening between the first connector housing and the lever for accommodating the lever. The first connector also includes a panel seal for sealing an opening between the first connector housing and the panel.

The activation element of the locking mating member is designed such that when it comes in contact with the corresponding activation member of the lever locking mechanism to generate a biasing force. The biasing force generated is sufficient to displace the lever outwardly from the first connector housing, thereby moving the blocking element of the lever away from the blocking surface. Once the lever is released from the blocking surface, it can move from the pre-lock position to the locked position to secure the first and second connector housings in the mated state. The blocking surface of the first connector housing may be in the form of a protrusion is configured to positioned on the rotating path of the lever when the lever is the pre-lock position, and the connector housing are uncoupled, or the second connector housing is absent. Once the lever is released from the pre-lock position, it is ready to be rotated towards the locked position. Upon rotation of the lever, the biasing force exerted by the activation element of the locking mating member may cease, and the lever may return to its original position in the first connector housing. During displacement of the lever, the sealing integrity of the electrical connector is maintained.

According to an aspect of the present disclosure, the activation element is in the form of a protruding surface. For example, the activation element may protrude from the locking mating member of the second connector. The activation element may be provided with an angled surface configured to come in contact with a corresponding activation surface of the corresponding activation member on the locking mechanism of the lever. The activation element is designed such that protrudes from the surface of the locking mating member of the second connector housing. As such, when the first and second connector housings are positioned in the pre-mated state, the activation element is aligned with a corresponding activation member of the lever locking mechanism.

According to an aspect of the present disclosure, the locking mechanism of the lever includes an engagement element configured to engage, when the lever is in the pre-lock position, with a corresponding receiving element on the locking mating member of the second connector housing to releasably secure the first and second connector housings in the pre-mated state. According to an aspect of the present disclosure, upon pivoting the lever towards the locked position, the engagement element is released from the receiving element. For example, the receiving element may be in the form of a cavity configured to receive the engagement element. The engagement element may be in the form of a protrusion, extending from a surface of the lever locking mechanism. Furthermore, the receiving element may be in the form of a recess, an opening, and the like.

Securing the first and second connector housings in the pre-mated state, enables the operator to operate the lever with only one hand, thereby overcoming the disadvantages of the prior art, which requires the operator to use both hands to complete the electrical connector assembly.

According to an aspect of the present disclosure, positioning of the first and second connector housing in the pre-mated state generates an audible sound. The audible sound provides a verifiable signal that the first and second connector housings are in the pre-mated state and that the lever is ready to rotatably move to the locked position.

According to an aspect of the present disclosure, the lever is U-shaped including a first lever arm and a second lever arm. It should be noted that the lever may also be provided with only one lever arm.

According to an aspect of the present disclosure, the first connector housing includes holding means on opposing sides for releasably securing the first and second lever arms.

According to an aspect of the present disclosure, the holding means include the lever seal. For example, the holding means may be a latching mechanism configured to releasably secure each lever arm through a corresponding opening of the first connector housing. The lever seal prevents any dust and humidity to enter the electrical connector through the openings.

According to an aspect of the present disclosure, each of the first and second lever arms includes a locking mechanism configured to engage, upon pivoting the lever to the locked position, with corresponding locking mating members of the second connector housing. For example, the locking mechanism may include a gear tooth, which engages with the receiving element of the locking mating member.

According to an aspect of the present disclosure, the lever seal and the panel seal are integrally formed as a single sealing member. In this way, the single sealing member can allow quicker and simpler assembly as compared to having to assemble two separate sealing members during the assembly process.

According to an aspect of the present disclosure, the electrical connector is a door to body connector for an automotive vehicle. For example, the first and second connector housings may be connected through an opening in a panel of a door or the like of the automotive vehicle. For example, the second connector housing may be provided through an opening at one side of the panel, and the first connector housing may be positioned on top of the second connector on the other side of the panel. The first connector housing may be provided with a sealing member that is configured, upon coupling of the first and second connector housings, to come in contact with a surface of the panel, thereby sealing the connection between the first and second connector housings. For example, the sealing member may be connected to the first connector housing by molding. The sealing member may be molded in one piece to the first connector housing thereby sealing the contact edge of the first connector housing with the metal panel of the automotive vehicle. The sealing member may be formed using a 2K injection molding process. The sealing member on the contact edge of the first connector together with the sealing member of the holding means may enhance the watertightness of the electrical connector, thereby providing a sealed electrical connector according to embodiments of the present disclosure.

According to a second aspect of the present disclosure, a method of assembling an electrical connector according to the first aspect of the present disclosure is provided, the method including the steps of:

providing first and second connector housings; mounting a lever on the first connector housing such that a blocking element of the lever cooperates with a blocking surface of the first connector housing to maintain the lever in the pre-lock position;

biasing the second connector housing to the first connector housing until an audible sound is generated, indicating that the first and second connector housings are in a pre-mated state and the blocking element of the lever is released from the blocking surface of the first connector housing;

and pivoting the lever from a pre-lock position to a locked position to secure the first and second connector housings in a mated state.

BRIEF DESCRIPTION OF THE DRAWINGS

An electrical connector with a lever locking member and mate assist mechanism is now described, by way of example with reference to the accompanying drawings, in which.

DETAILED DESCRIPTION

Figure 2:
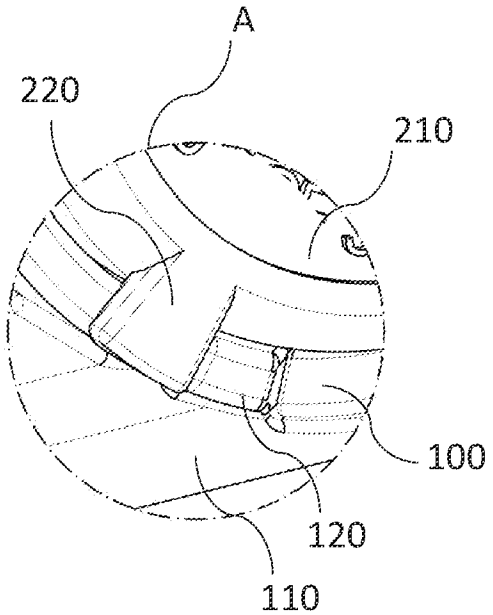
FIG. 2 is a close-up view of a section of the lever at the location of the blocking element showing the interaction between the blocking element of the lever and a blocking surface of the first connector when the lever is in the pre-lock position according to embodiments of the present disclosure.

The following discussion provides many exemplary embodiments of the inventive subject matter. Although each embodiment represents a single combination of inventive elements, the inventive subject matter is considered to include all possible combinations of the disclosed elements. Thus, if one embodiment includes elements A, B, and C, and a second embodiment includes elements B and D, then the inventive subject matter is also considered to include other remaining combinations of A, B, C, or D, even if not explicitly disclosed.

For simplicity and clarity of illustration, reference numerals may be repeated among the figures to indicate corresponding or analogous elements. Numerous details are set forth to provide an understanding of the examples described herein. The examples may be practiced without these details. In other instances, well-known methods, procedures, and components are not described in detail to avoid obscuring the examples described. The description is not to be considered as limited to the scope of the examples described herein.

Figure 1:
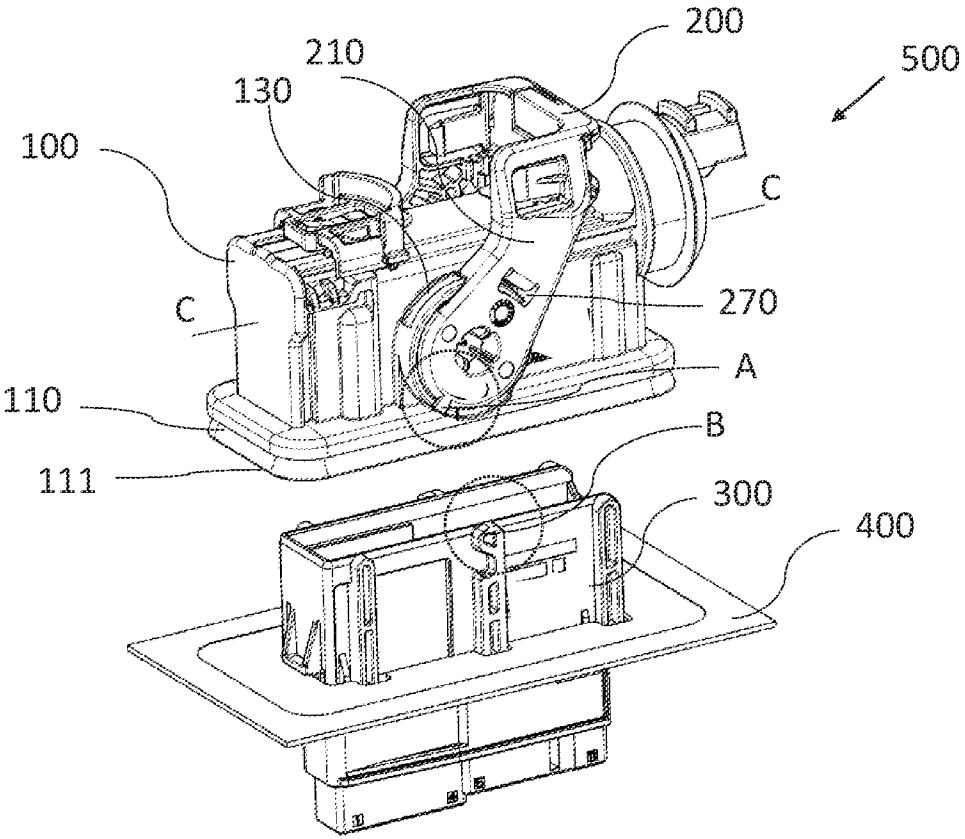
FIG. 1 shows a perspective view of the different components of an electrical connector according to embodiments of the present disclosure.
Figure 4:
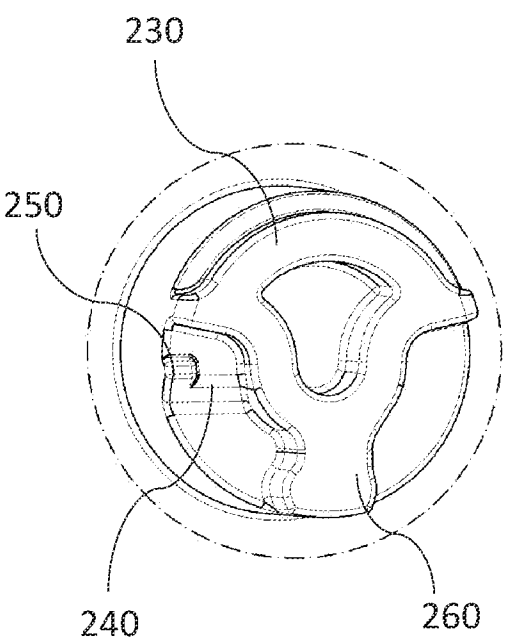
FIG. 4 shows a cross-sectional view of a section of the lever locking mechanism along section line C-C in FIG. 1, according to embodiments of the present disclosure.
Figure 3:
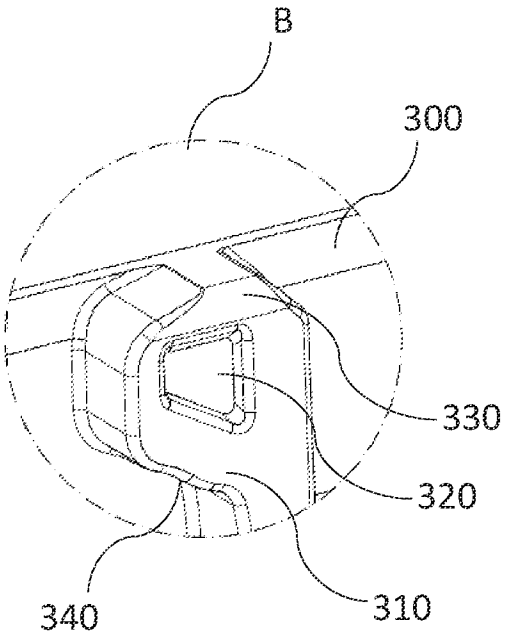
FIG. 3 is a close-up view of a section of the locking mating member of the second connector housing according to embodiments of the present disclosure.
Figure 5:
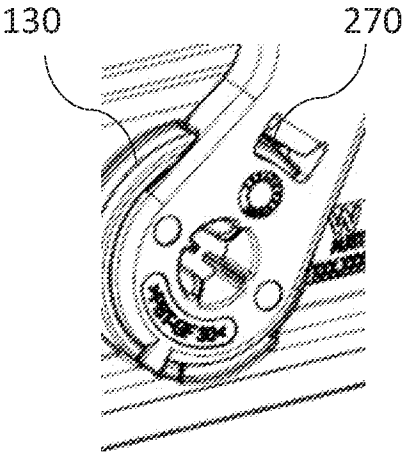
FIG. 5 shows a close-up view at the location where the lever arm is releasably secured on the first connector housing according to embodiments of the present disclosure.

Referring now to FIGS. 1 to 5, an electrical connector 500 may be provided according to embodiments of the present disclosure. As shown in FIG. 1, the electrical connector 500 includes a first connector housing 100, a second connector housing 300, and a mate assist mechanism including a lever 200. The first and second connector housings 100, 300 may engage together in a male-female connection. In particular, the first connector housing 100 may be a female connector housing configured to engage with the second connector housing 300 being a male connector housing. In particular, and referring to FIG. 1, the second connector housing 300 being a male connector housing may be configured to fit inside the first connector housing 100 being a female connector housing. The first connector housing 100 is provided with a panel seal 110 configured to seal a contact edge 111 of the first connector housing 100 with a panel. The panel may be a metal panel 400 of an automotive vehicle. The panel seal 110 may be formed on a recess around the opening of the first connector housing 100 using a 2K injection molding process. It should be noted that a pre-molded sealing member may be equally used and manually mounted on the opening of the first connector housing 100. The panel seal 110 is configured, upon coupling of the first and second connector housings 100 and 300, to enhance the watertightness of the electrical connector 500. The mate assist mechanism is configured to couple and uncouple the first and second connector housings 100, 300 by pivoting of the lever 200 between a pre-lock position and a locked position. The pivoting of the lever 200 to the locked position causes the first and second connector housings 100, 300 to be secured in a mated state. To uncouple the first and second connector housings 100, 300, the lever 200 is pivoted in the opposite direction. The lever 200 may be provided with two lever arms 210, each pivotably mounted on corresponding openings 140 in the first connector housing 100. The openings 140 accommodate the lever arms 210. For example, holding means may be provided for releasably securing the lever arms 210 on the corresponding openings 140 on the first connector housing 100. As shown in FIG. 5, the holding means may be in the form of a latching mechanism 270 including an engagement element, which may be provided on the lever arm 210, configured to cooperate with a corresponding catch 130, which may be provided on the first connector housing 100. For example, the catch 130 may be in the form of a recess provided around a section of the opening in the first connector housing 100 configured to cooperate with the latching mechanism 270 of the lever arm 210. The holding means ensures that the lever arm 210 does not unintentionally disengage from the first connector housing 100 upon pivoting of the lever 200 between the pre-lock and locked positions. The lever 200 is provided with a blocking element 220, which is configured to cooperate, when the first and second connector housings 100, 300 are in an uncoupled state or the second connector housing 300 is absent, with a blocking surface 120 of the first connector housing 100. For example, as shown in FIG. 2, the blocking surface 120 may be provided along the lever rotating path, thereby preventing the lever 200 from moving from the pre-lock position to the locked position. The second connector housing 300 is provided with a locking mating member 310, which is shown in FIG. 3. The locking mating member 310 includes a mating surface 340 configured to cooperate, when the lever 200 is moved to the locked position, with a locking member 260 of the lever locking mechanism 230 to secure the first and second connector housings 100, 300 in a mated state. The mating surface 340 of the locking mating member 310 may be in the form of an opening, recess, or another element of similar functionality that cooperates with the locking member 260 of the lever locking mechanism 230. The locking member 260 may be in the form of a gear mechanism including at least one gear tooth, as shown in FIG. 4. The locking mating member 310 may also be provided with a receiving element 320, which may be in the form of a cavity, or a recess, which is configured to receive when the first and second connector housings 100, 300 are in the pre-mated state, with an engagement element 250 of the lever locking mechanism 230, thereby releasably securing the first and second connector housings 100, 300 in the pre-mated state. The engagement element 250 may be in the form of a protruding member, as shown in FIG. 4. The locking mating member 310 may be further provided with an activation element 330 configured to cooperate, when the first and second connector housings 100, 300 are in the pre-mated state, with a corresponding activation member 240 of the lever locking mechanism 230. For example, the activation element 330 may be formed as part of a wall of the receiving element 320 and may be provided with a slanted surface. The corresponding activation member 240 may be part of the gear mechanism of the lever locking mechanism 230, as shown in FIG. 4. Similarly, the activation element 330 may be provided with a slanted surface. The slanted surface is configured in an exemplary arrangement such that the lever is deflected by the second connector housing to release the lever locking mechanism.

Figure 6:
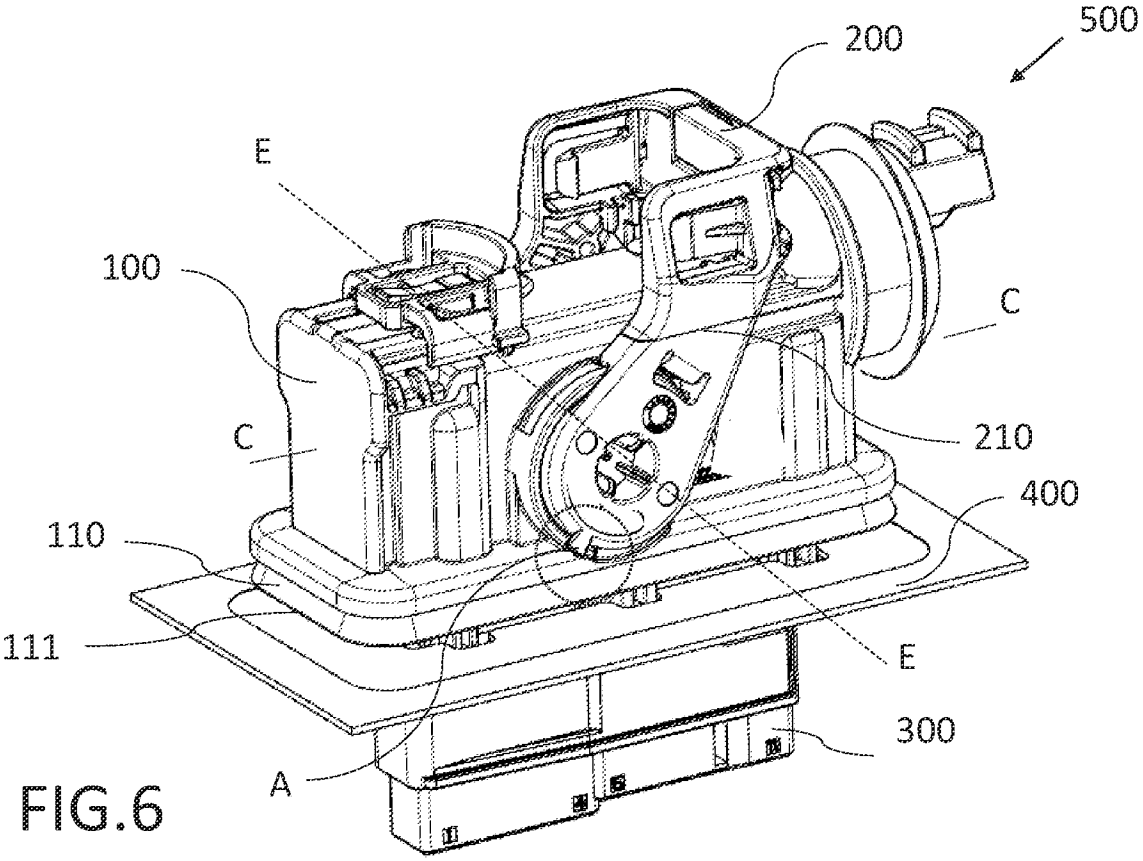
FIG. 6 shows an electrical connector with the first and second connector housings in the pre-mated state according to embodiments of the present disclosure.
Figure 8:
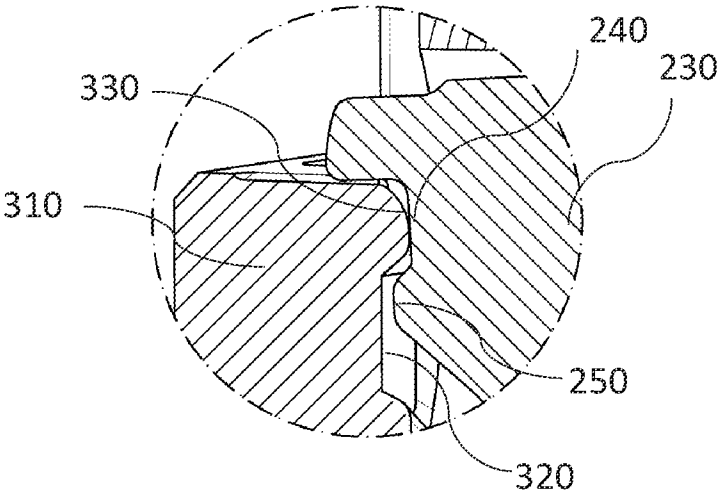
FIG. 8 is a cross-sectional view along section line D-D at the location of the engagement element of the lever locking mechanism according to embodiments of the present disclosure.
Figure 7:
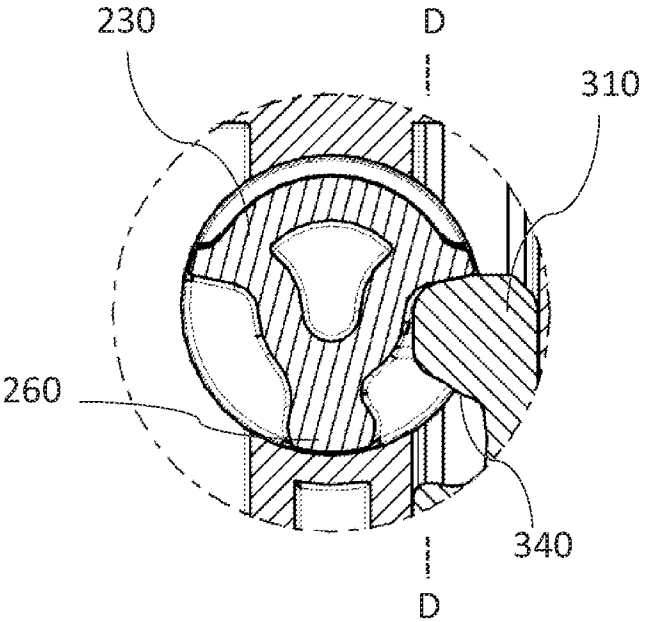
FIG. 7 shows a close-up cross-sectional view of the first and second connector housings being engaged at the pre-mated state according to embodiments of the present disclosure.
Figure 10:
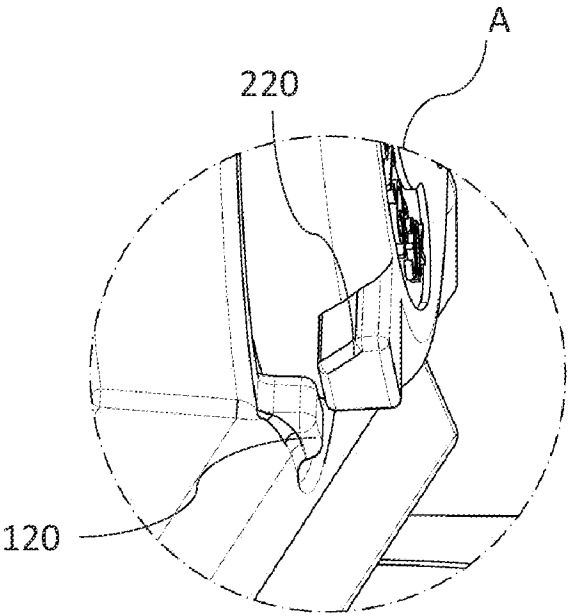
FIG. 10 shows a close-up of the lever blocking element being released from the blocking surface of the first connector housing as a result of the first and second connector housings being in the pre-mated state according to embodiments of the present disclosure.
Figure 9:
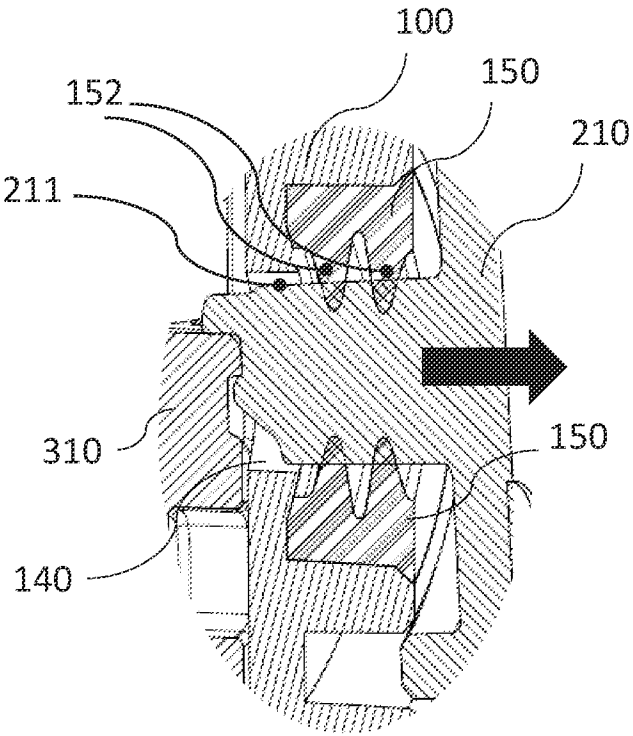
FIG. 9 is a cross-sectional view along section line E-E at the location of the lever locking mechanism showing the lever being displaced by the activation element of the locking mating member of the second connector housing when the first and second connector housings are in the pre-mated state.

Turning now to FIGS. 6 to 10, the configuration of the electrical connector 500 with the first and second connector housings 100, 300 secured in the pre-mated state is shown in FIG. 6. To position the first and second connector housings 100, 300 in the pre-mated state, the first connector housing 100 is pushed into the second connector housing 300 in a male-female connection until an audible sound is generated, indicating that the engagement element 250 of the lever locking mechanism 230 is in engagement with the receiving element 320 of the locking mating member 310, as shown in FIGS. 7 and 8. At the pre-mated state, the activation element 330 is configured to be in contact with the corresponding activation member 240 of the lever locking mechanism 230. As such, the activation element 330 generates a biasing force on the activation element 330, causing the lever arm 210 to be displaced outwardly from the first connector housing 100. As shown in FIG. 9, the lever arm 210 moves outwardly from the corresponding opening 140 in the first connector housing 100, in the direction of the arrow, without compromising the integrity of a lever seal 150 provided around the opening 140 of the first connector housing 100. The displacement causes the blocking element 220 of the lever 200 to be released from the blocking surface 120 of the first connector housing 100 and the lever 200 becomes free to move from the pre-lock position to the locked position as shown in FIG. 10.

Figure 12:
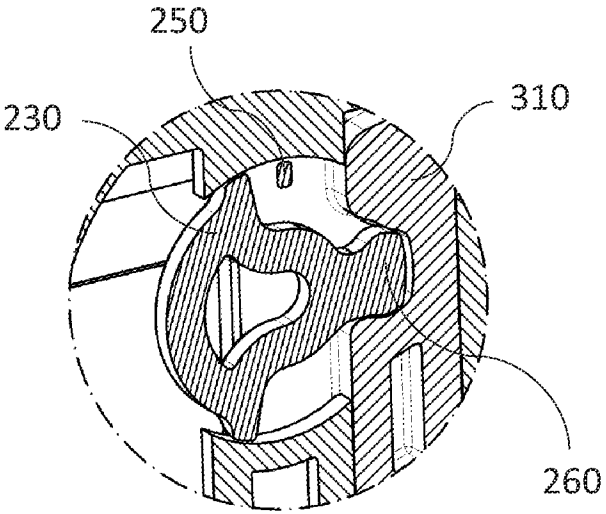
FIG. 12 shows a cross-sectional view of the lever locking mechanism being in contact with the corresponding locking mating member of the second connector housing to secure the first and second connector housings in the mated state.
Figure 11:
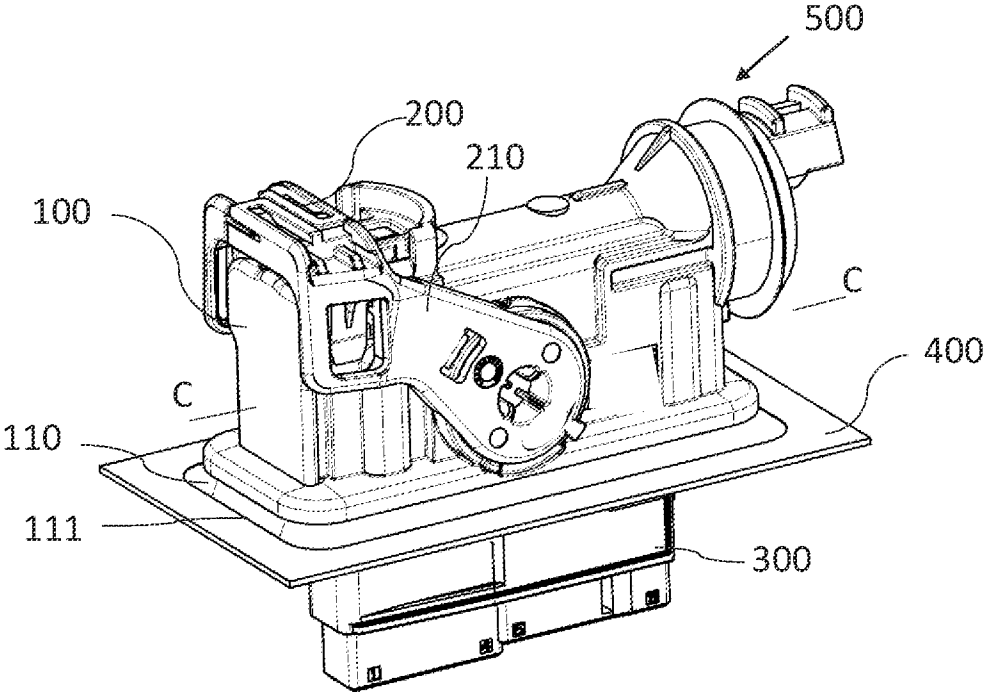
FIG. 11 shows an electrical connector with the lever in the locked position and the first and second housings secure in the mated state.
Figure 13:
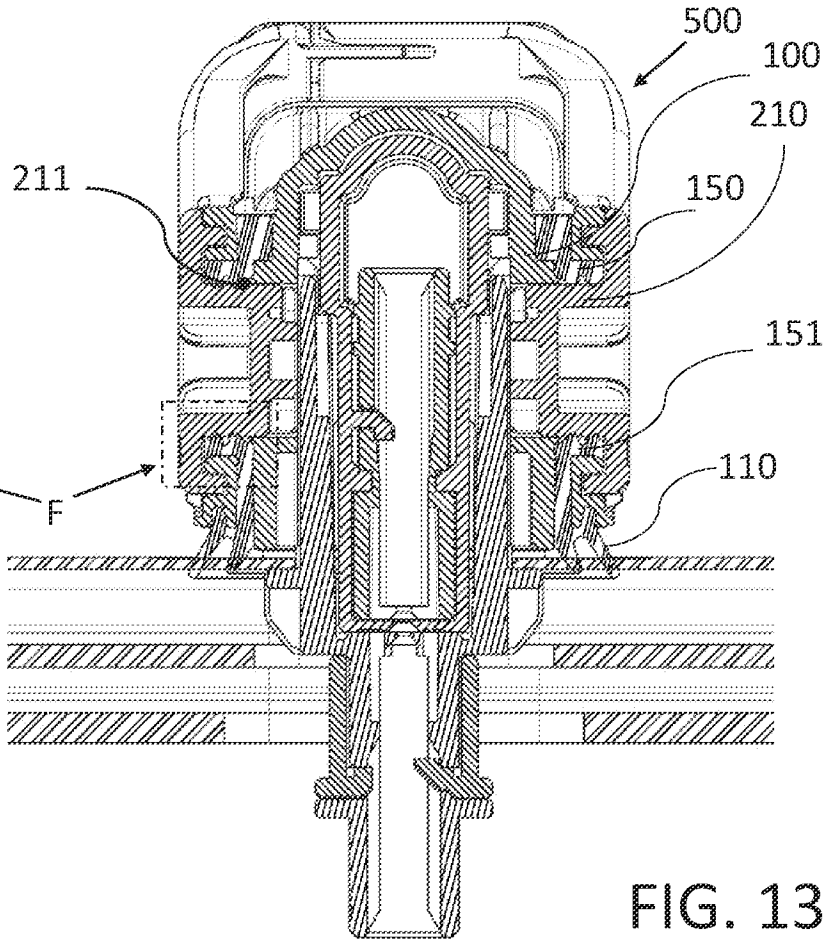
FIG. 13 shows a cross-sectional view of the electrical connector including an integrally formed single sealing member according to an embodiment of the present disclosure.
Figure 13A:
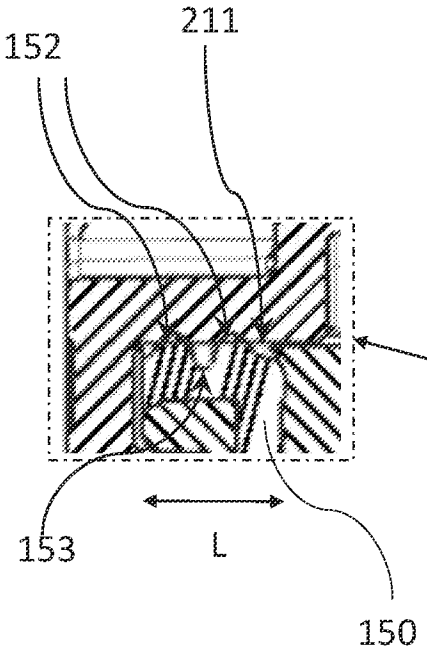
FIG. 13A shows an enlarged view of a portion of the lever seal of the arrangement of FIG. 13.
Figure 14:
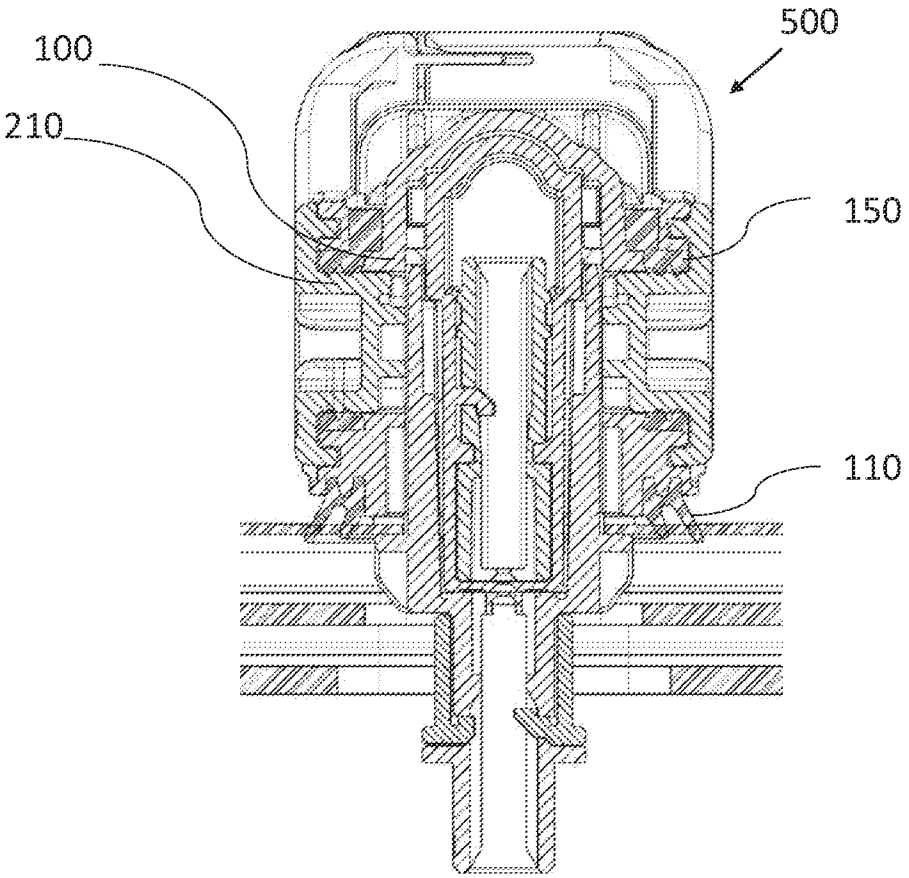
FIG. 14 shows a cross-sectional view of the electrical connector including a lever seal and a separate panel seal, according to an embodiment of the present disclosure.

FIGS. 11 and 12 show the electrical connector 500 with the lever 200 in the locked position and the first and second connector housings 100, 300 in the mated state. As shown in FIG. 11, in the mated state, the panel seal 110 is configured to be in contact with the metal panel 400 of the automotive vehicle thereby providing a watertight connection between the contact edge 111 of the first connector housing 100 and the metal panel 400. Furthermore, with the provision of the lever seal 150 of the holding means, a watertight connection is established between the first connector housing 100 and the lever arms 210. As such, a sealed electrical connector 500 is provided according to embodiments of the present disclosure. As shown in FIGS. 13, 13A, and 14, in the mated state, the second connector housing 300 may be configured to fit inside the first connector housing 100. In this configuration, the first connector housing 100 is disposed between the second connector housing 300 and the lever 200. As described above, the first connector housing 100 includes the lever seal 150 for sealing the opening 140 between the first connector housing 100 and the lever 200 and the panel seal 110 for sealing an opening between the first connector housing 100 and the metal panel 400. As such, a watertight connection is established between the first connector housing 100 and the lever arms 210 and between the first connector housing 100 and the second connector housing 300. Referring to FIGS. 13 and 13A, the lever seal 150 and the panel seal 110 may be an integrally formed single sealing member 151. Alternatively, referring to FIG. 14, the lever seal 150 and the panel seal 110 may be two separate and discrete sealing members. As shown in FIG. 12, upon positioning the lever 200 in the locked position, the lever locking mechanism 230 cooperates with the locking mating member 310 to secure the first and second connector housings 100, 300 in the mated state. In the locked position, the locking member 260 of the lever locking mechanism 230 engages with the mating surface 340 of the locking mating member 310, thereby securing the first and second connector housings in the mated state. Pivoting of the lever 200 from the pre-lock position to the lock position causes the disengagement of the engagement element 250 from the receiving element 320. The assembly of the electrical connector 500 may be reversed by pivoting of the lever 200 from the locked position to the pre-lock position, which causes the first and second connector housings 100, 300 to be uncoupled from one another.

In the connector assembly of the present disclosure, the displacement of the lever occurs along the complete surface of the lever which is located in contact with lever seal 150 inside the first connector housing 100, and thus the sealing function will not be affected during the release of the lever lock.

As illustrated in the exemplary arrangement of FIGS. 9, 13, 13A, and 14, portions of the lever arms 210 are located in the opening 140 surrounded by and in contact with the lever seal within the first connector housing. By virtue of this configuration, the sealing function between the lever, the lever seal and the first connector housing is not affected during the release of the lever lock or displacement of the level within the opening 140.

Effectively, the lever 200 is located within the opening 140 of first connector housing 100 such that a peripheral surface 211 of the lever arm 210, is proximate to the lever seal 150, for engagement with the lever seal. In the exemplary arrangement of FIGS. 13, 13A, and 14, the peripheral surface 211 of the lever arm 210 within the first connector housing has a generally cylindrical or annular form. A first portion of the surface 211 of the lever arm contacts the lever seal 150. The lever seal 150 and surface 211 overlap and contact over a contact length L and a longitudinally extending contact area. The sealing function is provided over a contact length L and has an elongated form. When the lever is displaced, for example outwardly relative to the opening 140 (as described with reference to FIG. 9) contact between the seal 150 and the surface 211 of the lever is maintained. The lever seal 150 includes a resilient seal configured to maintain a sealing function and to accommodate the displacement of the lever surface relative thereto. In one exemplary arrangement as illustrated in FIG. 9, the seal includes a plurality of ribs 152 that extend outwardly from a body of the seal to contact the surface 211. The lever seal 150 includes a trough 153 between ribs 152.

Accordingly, as described above, the lever seal 150, is located at least partially between the first connector housing 100 and the lever 200 and acts to provide a seal between these components. The lever seal 150 seals the opening 140 between the first connector housing and the lever. The lever seal 150 advantageously provides and maintains a continuous seal between the lever and the first connector housing. The sealing function is active also as the components (lever and housing) move relative to each other. Accordingly, the lever is sealingly coupled to the first connector housing 100.

Advantageously the arrangement of the specification provides for a lever seal, that is located between the lever and first connector housing and a panel seal located between the first connector housing and the panel. The seal is not limited to an arrangement between the first connector housing and the second connector housing. The arrangement of the specification provides for deflection of the lever along the entire surface of the lever located within the lever seal and within the first connector housing, this arrangement advantageously provides a sealing function that is not affected during the release of lever lock or during activation.

While the present disclosure has been described in terms of the preferred embodiments thereof, it is not intended to be so limited, but rather only to the extent set forth in the claims that follow.

The invention claimed is:

1. An electrical connector, comprising:

a first connector housing and a second connector housing configured to be coupled to one another through an opening of a panel, wherein the second connector housing is configured to fit inside the first connector housing; and a mate assist mechanism comprising a lever pivotably and sealingly mounted to an outside of the first connector housing, wherein the mate assist mechanism is configured to couple and uncouple the first and second connector housings by pivoting of the lever between a pre-lock position and a locked position;

the lever comprising:

a locking mechanism configured, upon pivoting the lever to the locked position, to engage with a corresponding locking mating member of the second connector housing to secure the first and second connector housings in a mated state, and a blocking element configured to cooperate when the first and second housings are in an uncoupled state or the second connector housing is absent, with a blocking surface of the first connector housing to maintain the lever in the pre-lock position;

wherein the locking mating member of the second connector housing comprises an activation element configured to cooperate with a corresponding activation member on the locking mechanism of the lever when the first and second connector housings are in a pre-mated state, wherein the activation element is configured to exert a biasing force on the corresponding activation member of the locking mechanism, thereby causing the lever to be displaced outwardly from the first connector housing such that the blocking element of the lever is released from the blocking surface of the first connector housing and the lever becomes free to move to the locked position, and wherein the first connector housing comprises a lever seal for sealing an opening between the first connector housing and the lever for accommodating the lever and a panel seal for sealing an opening between the first connector housing and the panel.

2. The electrical connector of claim 1, wherein the activation element is in a form of a protruding surface.

3. The electrical connector of claim 1, wherein the activation element has a slanted surface configured to come in contact with a corresponding activation surface of the corresponding activation member on the locking mechanism of the lever.

4. The electrical connector of claim 1, wherein the locking mechanism of the lever comprises an engagement element configured to engage, when the lever is in the pre-lock position, with a corresponding receiving element on the locking mating member of the second connector housing to releasably secure the first and second connector housings in the pre-mated state.

5. The electrical connector of claim 4, wherein upon pivoting the lever to the locked position, the engagement element is configured to be released from the receiving element.

6. The electrical connector of claim 4, wherein the receiving element is in a form of a cavity configured to receive the engagement element.

7. The electrical connector of claim 6, wherein the activation element of the locking mating member of the second connector housing forms a wall of the cavity.

8. The electrical connector of any one of claim 4, wherein upon positioning the first and second connector housings in the pre-mated state, an audible sound is generated.

9. The electrical connector of claim 1, wherein the lever is U-shaped and comprises first and second lever arms.

10. The electrical connector of claim 9, wherein the first connector housing comprises holding means on opposing sides for releasably securing the first and second lever arms.

11. The electrical connector of claim 10, wherein the holding means comprise the lever seal.

12. The electrical connector of claim 9, wherein each of the first and second lever arms comprises a locking mechanism configured to engage, upon pivoting the lever to the locked position, with corresponding locking mating members of the second connector housing.

13. The electrical connector of claim 1, wherein the lever seal and the panel seal are integrally formed as a single sealing member.

14. The electrical connector of claim 13, wherein the electrical connector is a door to body connector for an automotive vehicle.

15. A method of assembling an electrical connector, comprising:

providing a first connector housing and a second connector housing configured to be coupled to one another through an opening of a panel, wherein the second connector housing is configured to fit inside the first connector housing, the first connector housing having a mate assist mechanism comprising a lever pivotably and sealingly mounted to an outside of the first connector housing, wherein the mate assist mechanism is configured to couple and uncouple the first and second connector housings by pivoting of the lever between a pre-lock position and a locked position, wherein the lever includes a locking mechanism configured, upon pivoting the lever to the locked position, to engage with a corresponding locking mating member of the second connector housing to secure the first and second connector housings in a mated state and a blocking element configured to cooperate when the first and second housings are in an uncoupled state or the second connector housing is absent, with a blocking surface of the first connector housing to maintain the lever in the pre-lock position, wherein the locking mating member of the second connector housing comprises an activation element configured to cooperate with a corresponding activation member on the locking mechanism of the lever when the first and second connector housings are in a pre-mated state, wherein the activation element is configured to exert a biasing force on the corresponding activation member of the locking mechanism, thereby causing the lever to be displaced outwardly from the first connector housing such that the blocking element of the lever is released from the blocking surface of the first connector housing and the lever becomes free to move to the locked position, and wherein the first connector housing comprises a lever seal for sealing an opening between the first connector housing and the lever for accommodating the lever and a panel seal for sealing an opening between the first connector housing and the panel, the method;

mounting the lever on the first connector housing such that the blocking element of the lever cooperates with the blocking surface of the first connector housing to maintain the lever in the pre-lock position;

biasing the second connector housing to the first connector housing until an audible sound is generated, indicating that the first and second connector housings are in the pre-mated state and the blocking element of the lever is released from the blocking surface of the first connector housing; and pivoting the lever from the pre-lock position to the locked position to secure the first and second connector housings in the mated state.

16. An electrical connector, comprising:

a first connector housing configured to be coupled to a second connector housing; and a lever pivotably mounted to an outside of the first connector housing and configured to couple and uncouple the first and second connector housings by pivoting between a pre-lock position and a locked position;

the lever comprising:

a locking mechanism configured, upon pivoting the lever to the locked position, to engage with a corresponding locking mating member of the second connector housing to secure the first and second connector housings in a mated state, and a blocking element configured to cooperate with a blocking surface of the first connector housing to maintain the lever in the pre-lock position when the first and second housings are in an uncoupled state, wherein the locking mating member of the second connector housing comprises an activation element configured to cooperate with a corresponding activation member on the locking mechanism of the lever when the first and second connector housings are in a pre-mated state and wherein the activation element is configured to exert a biasing force on the corresponding activation member of the locking mechanism, thereby causing the lever to be displaced outwardly from the first connector housing such that the blocking element of the lever is released from the blocking surface of the first connector housing and the lever becomes free to move to the locked position.

17. The electrical connector of claim 16, wherein the first connector housing further comprises a lever seal disposed within a first opening between the first connector housing and the lever and a panel seal disposed within a second opening between the first connector housing and the panel.

18. The electrical connector of claim 17, wherein the lever seal and the panel seal are integrally formed as a single sealing member.

19. The electrical connector of claim 1, wherein the lever is U-shaped and comprises first and second lever arms.

20. The electrical connector of claim 19, wherein the first connector housing comprises means for releasably securing the first and second lever arms.

* * * * *